US008322422B2

(12) United States Patent
Freyer

(10) Patent No.: US 8,322,422 B2
(45) Date of Patent: Dec. 4, 2012

(54) METHOD OF REMOVING A DEVICE IN AN ANNULUS

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 582 days.

(21) Appl. No.: 12/304,947

(22) PCT Filed: Jun. 25, 2007

(86) PCT No.: PCT/US2007/071975

§ 371 (c)(1),
(2), (4) Date: Jan. 4, 2010

(87) PCT Pub. No.: WO2008/002850

PCT Pub. Date: Jan. 3, 2008

(65) Prior Publication Data

US 2010/0147520 A1 Jun. 17, 2010

(30) Foreign Application Priority Data

Jun. 26, 2006 (NO) ..... 20062972

(51) Int. Cl.
*E21B 29/00* (2006.01)

(52) U.S. Cl. ..... 166/298; 166/55; 166/376

(58) Field of Classification Search ..... 166/55, 166/298, 376, 55.1, 55.6, 55.7
See application file for complete search history.

(56) References Cited

U.S. PATENT DOCUMENTS

| | | | | |
|---|---|---|---|---|
| 3,130,786 | A | 4/1964 | Brown et al. | |
| 4,296,822 | A | 10/1981 | Ormsby | |
| 4,428,430 | A | 1/1984 | Terrell, I et al. | |
| 4,450,907 | A | 5/1984 | Clark et al. | |
| 5,494,103 | A | 2/1996 | Surjaatmadja et al. | |
| 5,709,269 | A * | 1/1998 | Head | 166/376 |
| 6,478,093 | B1 * | 11/2002 | Hilts et al. | 166/387 |
| 6,854,521 | B2 * | 2/2005 | Echols et al. | 166/387 |
| 7,461,695 | B2 * | 12/2008 | Boney et al. | 166/278 |
| 2001/0045282 | A1 | 11/2001 | Robinson | |
| 2005/0199401 | A1 * | 9/2005 | Patel et al. | 166/387 |

FOREIGN PATENT DOCUMENTS

| | | | |
|---|---|---|---|
| GB | 916579 | A | 1/1963 |
| RU | 2123106 | C1 | 12/1998 |

OTHER PUBLICATIONS

International Search Report and Written Opinion issued Dec. 27, 2007, for International Patent Application No. PCT/US07/71975, 6 pages.

International Preliminary Report on Patentability and Written Opinion issued Jan. 15, 2009, for International Patent Application No. PCT/US07/71975, 5 pages.

* cited by examiner

*Primary Examiner* — Giovanna Wright
(74) *Attorney, Agent, or Firm* — Smith IP Services, P.C.

(57) ABSTRACT

A method for removing at least a portion of an object in an annulus formed between an external surface of a tubular element and a wall surface. A method for removing an annulus packer, of the swellable type or the foam type, from an annulus in a wellbore comprises the placement of a jetting tool inside the tubular element and effecting a high-pressure fluid flow from the jetting tool to the object, whereby the object is removed.

16 Claims, 2 Drawing Sheets

METHOD OF REMOVING A DEVICE IN AN ANNULUS

CROSS-REFERENCE TO RELATED APPLICATIONS

The present application is a national stage application under 35 USC 371 of International Application No. PCT/US07/71975, filed Jun. 25, 2007, which claims priority to Norwegian Patent Application No. 20062972, filed Jun. 26, 2006. The entire disclosures of these prior applications are incorporated herein by this reference.

BACKGROUND

The invention relates generally to subterranean wells used for hydrocarbon extraction or other purposes, and more specifically to a method for removing at least a portion of an object in an annulus formed between an external surface of a tubular element and a wall surface. More specifically, a method for removing an annulus packer, of the swellable type or the foam type, from an annulus in a wellbore is described.

Annulus packers are commonly used to seal off portions of the annulus between a pipe (e.g. a production tubing) and the wellbore. One application is described in Norwegian Patent No. 312478, wherein an annular packer is arranged on the outside of a production tubing. The annular packer comprises a core having an elastic polymer. The packer swells by absorption of hydrocarbons and expands to seal the annular space between a production tubing and a well wall.

A person skilled in the art will also be familiar with other swellable packers, such as those which swell in water or water-based fluids, or foam type packers, such as those which expand in the presence of gas. Swellable packers in general are used to seal off portions of an annulus between a pipe and a wellbore wall.

Sometimes a need arises for pulling the pipe or tubing (removal from, or displacement in, the well). With systems employing mechanical or inflatable annulus packers, this pulling is achieved by mechanically releasing or deflating the packers. However, pipes, tubing, etc., set with swellable packers or foam type packers are essentially permanently set.

Thus, in order to pull a pipe or tubing, etc., set with swellable packers or foam type packers, known techniques include, e.g., a mechanical milling process to remove the packer. This is an iterative process, requiring several runs. For example, a first run will be necessary in order to cut the pipe; then an overshot mill is run, before the pipe is cut below the packer in a third run. The procedure must be repeated for each packer in order to retrieve the pipe. One can understand how the pulling operation therefore consumes considerable rig time and entails a considerable cost impact.

Various methods and systems exist for performing downhole cutting operations, either in subterranean formations, packers or tubing.

RU 2123106 discloses a method for cutting perforation channels using abrasive fluids.

U.S. Pat. No. 4,296,822 discloses a multi-purpose fluid flow assisted downhole tool, that is adapted for attachment to the lower end of the pipe string to be extended into a well bore, and capable of cutting sample cores from subsurface formations.

U.S. Pat. No. 4,450,907 discloses a tool having a special overshot which attaches to a cut-off tubing on a packer. A method and apparatus for removing precipitated solids from above a packer in a well bore to the extent necessary to enhance the removal of the packer. The overshot comprises an opening which allows the tubing string to be passed through and into the annulus.

GB 916579 discloses a milling apparatus for removing a resilient packer from a well bore.

U.S. Pat. No. 4,428,430 discloses a method and apparatus for perforating a circulation port through the sidewall of a drill collar to provide circulation of weighted drilling fluid down through the drill string and back up the well annulus. A chemical reactant wireline perforating tool is lowered to a designated position within a drill collar, and a single chemical flow jet forces a chemical reactant through the jet under high pressure and at high temperature to react with the drill collar metal and thereby remove a portion of the metal with the remaining metal defining a fluid circulation port through the drill collar wall. Fluid is subsequently pumped through the port to establish circulation. The apparatus includes a tool body defining a single fluid flow jet, pressure actuated slips with the body to support the body against movement within the drill pipe, a body of chemical within the tool, a reaction section to heat the chemical, a pressure responsive decentralizing mechanism to position to the tool and thereby place the flow jet into position to direct the chemical directly onto the interior wall of the drill collar.

U.S. Pat. No. 5,494,103 discloses a well jetting apparatus for use in fracturing a well. Fracture initiation is provided by forming openings through a well casing and then forming fan-shaped slots in the formation surrounding the casing. The slots are formed by the jetting apparatus which has at least one hydraulic jet. The jetting apparatus may be used in any well configuration.

Therefore, a need exists for a method whereby pipes or tubing set with swellable packers or foam type packers may be pulled easier and faster than with the known methods.

SUMMARY

A method is provided for removing at least a portion of an object in an annulus formed between an external surface of a tubular element and a wall surface, characterized by:

a) placing a jetting tool inside the tubular element, at a position proximal to the object in the annulus;

b) effecting a high-pressure fluid flow from the jetting tool, into an opening between an internal surface of the tubular element and the external surface of the tubular element;

c) feeding the fluid flow against an area of the object adjacent to said opening; and d) maintaining the fluid flow until the portion of the object is removed.

In an alternative embodiment, the opening is formed between steps a) and b) by effecting a fluid flow from the jetting tool, towards an internal surface of the tubular element whereby a fluid path is provided between the jetting tool and the object.

The method is suitable for removing devices in the annulus between a wellbore wall and a pipe, by means of a jetting tool inside the pipe.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
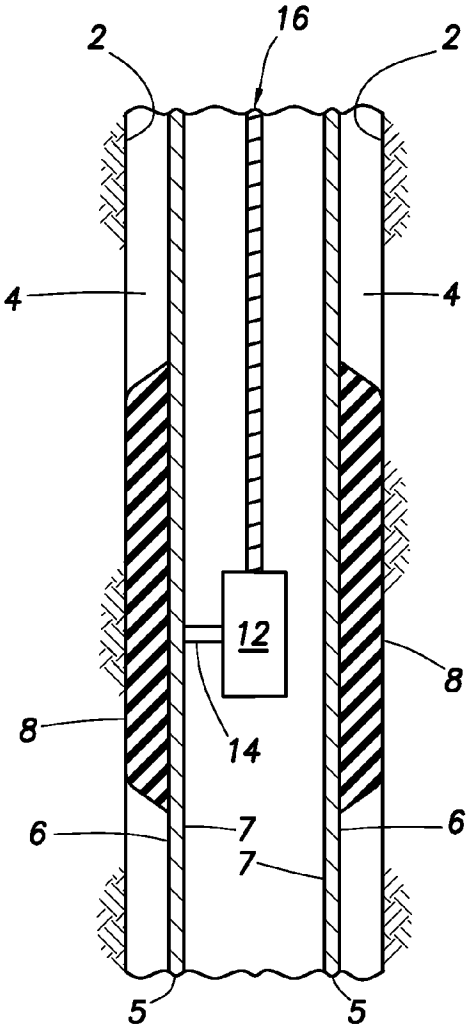
FIG. 1 is a longitudinal section drawing showing a jetting tool at a location in a subterranean well, prior to pipe penetration.

In FIG. 1, a pipe 5 having an internal wall surface 7 and an external wall surface 6, is shown set in a subterranean wellbore having a wall surface 2. This wellbore wall surface 2 may be a casing or liner, or—in the case of an open hole completion—may comprise subterranean rock or sediments. Alternatively, the pipe may be a coiled tubing string, and in an open hole it may be run into production tubing.

The pipe 5 is set in the well by means of annular packers 8, either of the swellable type or the foam type. The packer 8 is shown in a set (expanded) state, in the annulus 4 defined by the external surface 6 of the pipe 5 and the wellbore wall surface 2. The skilled person will understand that several packers normally are used to set a pipe. However, for clarity of illustration, FIG. 1 shows only one such packer.

Swellable packers and foam-type packers (a specific type of swellable packer) expand considerably when the pipe and packer have been deployed in the well. The expanded packer occupies a portion of the annulus 4 between the pipe's 5 external wall surface 6 and the wellbore wall surface 2, thus substantially fixing the pipe 5 in place in the well.

In a practical and exemplary application, a pipe 5 has a steel wall of a thickness of approximately 10 mm. The annulus packer 8 generally comprises a rubber material, and may in the expanded state have a thickness between approximately 10 mm and 60 mm, and a longitudinal length between approximately 0.3 m and 9 m when set in the annulus.

It is sometimes necessary to pull the pipe 5. This operation may be performed by, e.g., attaching a device (not shown) to that end of the pipe which is outside the well, and applying a suitable pulling force on the pipe. Friction forces between the pipe's external surface 6 and the wellbore wall 2 must thus be removed or at least reduced to an acceptable level whereby a movement of the pipe is feasible.

According to the present method, this is achieved by placing a jetting tool 12, having one or more nozzles, to the position in the pipe adjacent to the packer 8 to be removed, and by delivering a high pressure fluid jet 14 to the packer. In a practical application, a hydraulic jetting tool similar to the one disclosed in U.S. Pat. No. 5,494,103 may be used.

Figure 3:
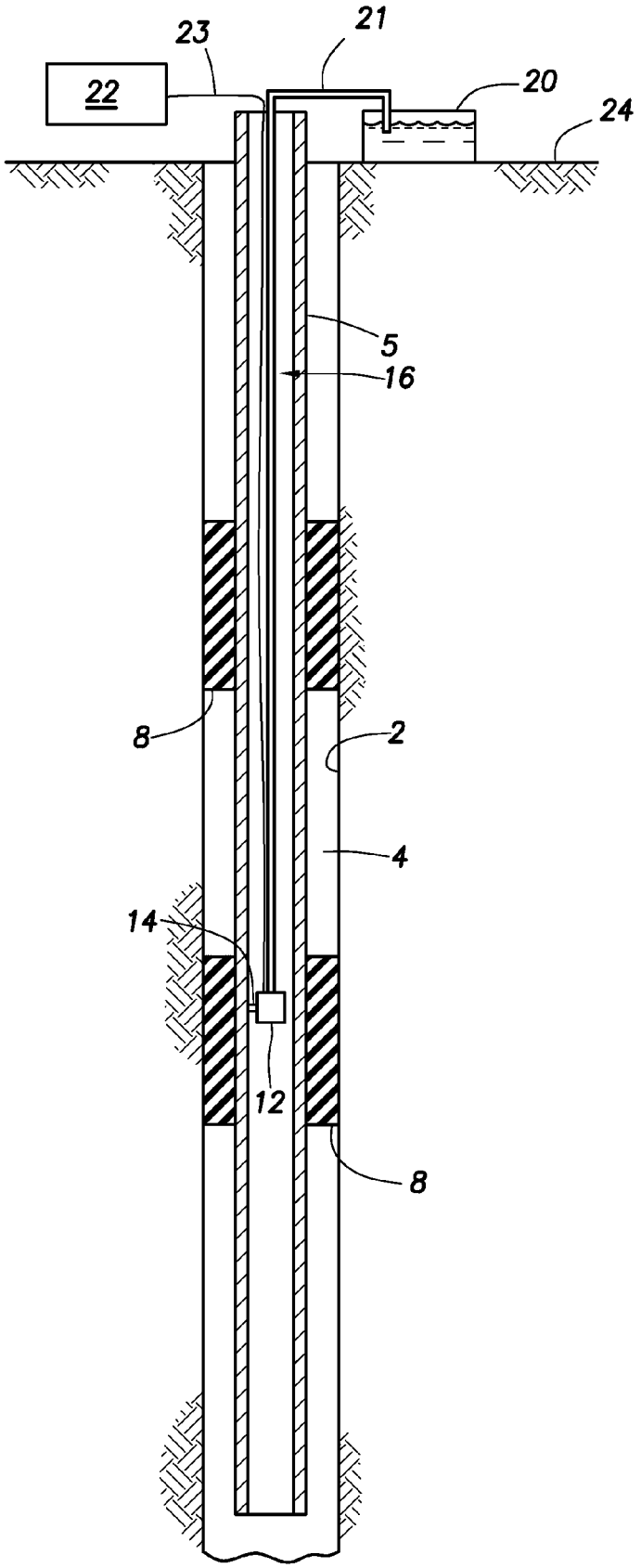
FIG. 3 is a longitudinal section drawing showing a jetting tool at a location in an open-hole subterranean well.

The jetting tool 12 is preferably conveyed into the pipe by a conveyor element 16, the purpose of which may comprise suspending the jetting tool 12 (in the case of a substantially vertical well), but also providing fluid under high pressure to the jetting tool 12, and optionally providing control and feedback signals between the jetting tool and a control unit. In FIG. 3, this is schematically illustrated by the conveyor element 16 comprising a line 21 for feeding a fluid under high pressure from a reservoir 20 to the jetting tool 12, and a control and feed-back line 23 between the jetting tool 12 and a control unit 22.

In the illustrated embodiment, the reservoir 20 and the control unit 22 are located above the earth's surface 24. In practical applications, the conveyor element 16 may comprise coiled tubing or a drillpipe.

When the jetting tool 12 is conveyed to the desired location in the pipe 5 with respect to the packer 8 that is to be removed, a fluid jet 14 is expelled from the jetting tool 12, towards an internal surface 7 of the pipe. The fluid may comprise abrasive compounds or the fluid may comprise chemicals, or both.

The pipe wall is thus perforated by the fluid jet in a manner known in the art, and an opening is provided between the internal surface 7 and the external surface 6 of the pipe. The fluid jet 14 is then directed through the opening in the wall of the pipe 5.

In the case of the fluid comprising abrasives, the high pressure fluid jet 14 preferably cuts a slot in the packer 8. A combination of the fluid's high velocity and its abrasive properties will initiate a disintegration process of the comparatively soft material of the expanded packer. The packer material, which in the expanded state is somewhat weakened, will not be able to withstand the abrasive jet.

In the case of the fluid comprising suitable chemicals, the high pressure impact of the fluid jet 14, augmented by the chemicals, will penetrate the packer's rubber matrix, whereby the packer will dissolve and/or disintegrate.

Figure 2:
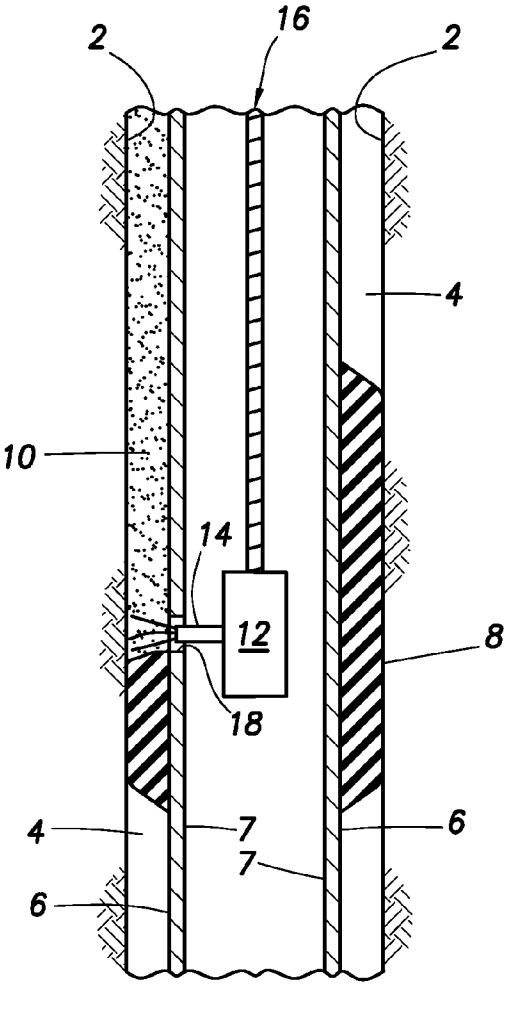
FIG. 2 is a longitudinal section drawing showing the jetting tool at a location in the well, following pipe penetration and partial disintegration of a packer.

FIG. 2 illustrates an intermediate stage of the invented method, showing a partly disintegrated packer following exposure to the high pressure fluid as explained above. Packer fragments 10 are moving away from the pipe wall opening due to the high pressure jet and/or due to the fragments' inherent buoyancy.

The above procedure may be repeated to remove remaining parts of the packer (if required), or to remove other packers along the pipe 5 (e.g., as shown in FIG. 3). The positioning of the jetting tool 12 within the pipe 5 may be recorded and controlled by the control unit 29. The positioning may be performed with or without depth correlation, running the jetting tool into the well in steps and perforating at regular (e.g., 0.3 m) intervals.

Figure 4:
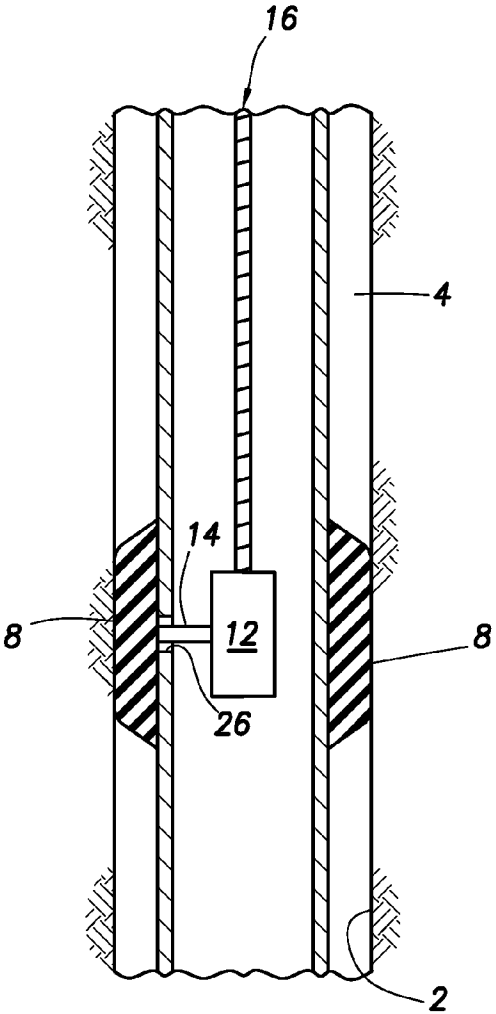
FIG. 4 is a longitudinal section drawing showing a jetting tool, in position opposite an annulus packer, in a pipe having pre-existing holes.

Although it will be convenient in most practical applications to form an opening in the pipe 5 wall by the hydraulic jet 14, as described above, the method also comprises the use of a pipe 5 having pre-existing holes 26, as illustrated by FIG. 4. In this configuration, the jetting tool 12 is positioned adjacent a hole 26 provided in the pipe 5, and the high pressure jet 14—comprising abrasives and/or chemicals—is delivered to the packer 8 through this hole 26.

Thus has been described a method for removing at least a portion of an object 8 in an annulus 4 formed between an external surface 6 of a tubular element 5 and a wall surface 2. The method includes the steps of placing a jetting tool 12 inside the tubular element 5, at a position proximal to the object 8 in the annulus; effecting a high-pressure fluid flow 14 from the jetting tool 12, into an opening 26 between an internal surface 7 of the tubular element 5 and the external surface 6 of the tubular element 5; feeding the fluid flow 14 against an area of the object 8 adjacent to said opening 26; and maintaining the fluid flow 14 until the portion of the object 8 is removed.

The opening 26 may be formed between the placing and effecting steps by effecting a fluid flow 14 from the jetting tool 12, towards an internal surface 7 of the tubular element 5 whereby a fluid path is provided between the jetting tool 12 and the object 8.

The object 8 may comprise a swellable packer or a foam-type packer. The wall surface 2 may comprise the wall of a subterranean well.

The jetting tool 12 may be removed from the tubular element following the completion of the maintaining step.

The high pressure fluid flow may be provided from a reservoir 20, via a supply line 21. The jetting tool 12 may be attached to a conveyor element 16. The conveyor element 16 may comprise the supply line 21. The conveyor element 16 may comprise coiled tubing. The conveyor element 16 may comprise a drillpipe.

The fluid flow may comprise abrasive compounds. The fluid flow may comprise chemical compounds.

The figures and description address generally vertical wells. The skilled person will understand, however, that the well orientation is not material to the invention. The invention also applies equally to cased and open-hole wells.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method for removing at least a portion of a swellable seal element from an annulus formed between an external surface of a tubular element and a wall surface, the method comprising the steps of:

placing a jetting tool inside the tubular element, at a position proximate the portion of the swellable seal element;

effecting a high-pressure fluid flow from the jetting tool, into an opening between an internal surface of the tubular element and the external surface of the tubular element;

directing the fluid flow toward the portion of the swellable seal element proximate the opening; and maintaining the fluid flow until the portion of the swellable seal element is removed.

2. The method of claim 1, wherein the opening is formed between the placing and effecting steps by effecting the fluid flow from the jetting tool toward the internal surface of the tubular element, whereby a fluid path is provided between the jetting tool and the portion of the swellable seal element.

3. The method of claim 1, wherein the swellable seal element is a component of at least one of a swellable packer and a foam-type packer.

4. The method of claim 1, wherein the wall surface comprises a wall of a subterranean well.

5. The method of claim 1, wherein the jetting tool is removed from the tubular element following completion of the maintaining step.

6. The method of claim 1, wherein the high pressure fluid flow is provided from a reservoir, via a supply line.

7. The method of claim 1, wherein the jetting tool is attached to a conveyor element.

8. The method of claim 7, wherein the conveyor element comprises a supply line.

9. The method of claim 7, wherein the conveyor element comprises coiled tubing.

10. The method of claim 7, wherein the conveyor element comprises a pipe string.

11. The method of claim 1, wherein the fluid flow comprises abrasive compounds.

12. The method of claim 1, wherein the fluid flow comprises chemical compounds.

13. A method of repositioning a tubular element in a well, the method comprising the steps of:

forming an opening in the tubular element between interior and exterior surfaces of the tubular element by use of a jetting tool;

flowing fluid through the opening; and removing at least a portion of a swellable seal element on the exterior surface of the tubular element as a result of the fluid flowing step, thereby permitting the tubular element to be repositioned in the well.

14. The method of claim 13, wherein the fluid flowing step further comprises flowing an abrasive through the opening.

15. The method of claim 13, wherein the fluid flowing step further comprises flowing a chemical through the opening, thereby degrading the swellable seal element.

16. The method of claim 13, further comprising the step of swelling the swellable seal element between the external surface of the tubular element and a wall of the well.

* * * * *